United States Patent [19]

Goettl

[11] 3,960,527

[45] June 1, 1976

[54] AIR DELIVERY AND TREATMENT APPARATUS

[76] Inventor: Adam D. Goettl, 4960 E. Palomino Road, Phoenix, Ariz. 85018

[22] Filed: Nov. 22, 1974

[21] Appl. No.: 526,392

[52] U.S. Cl. ..... 55/269; 55/419; 55/467; 62/427; 98/33 R; 415/219 C; 415/151; 417/423 R

[51] Int. Cl.[2] ..... B01D 51/10

[58] Field of Search ..... 55/467, 471–473, 55/269, 419; 98/33 A, 33 R; 62/262, 427; 415/201, 98, 151, 204, 206, 219 C; 165/122, 124, 126; 417/312, 313, 362, 423 R

[56] References Cited

UNITED STATES PATENTS

| | | | |
|---|---|---|---|
| 662,396 | 11/1900 | Davidson | 415/204 |
| 1,026,904 | 5/1912 | Burke | 417/423 R |
| 1,906,533 | 5/1933 | Burke | 165/126 |
| 1,935,538 | 11/1933 | Baumann | 417/423 R |
| 2,048,049 | 7/1936 | Baenninger | 415/147 |
| 2,201,437 | 5/1940 | Kice, Jr. | 415/155 |
| 2,358,695 | 9/1944 | Evans | 98/33 A |
| 2,641,404 | 6/1953 | Schwarz | 55/467 |
| 3,174,541 | 3/1965 | Brandt et al. | 165/122 |
| 3,209,668 | 10/1965 | Haerter | 98/39 |
| 3,464,487 | 9/1969 | Gold et al. | 165/122 |
| 3,746,464 | 7/1973 | Goettl | 415/201 |
| 3,802,493 | 4/1974 | Goeth | 165/60 |

*Primary Examiner*—Bernard Nozick
*Attorney, Agent, or Firm*—Herbert E. Haynes, Jr.

[57] ABSTRACT

A centrifugal blower assembly having apparatus for optionally directing inlet air thereto from a plurality of air sources and which may be equipped with or coupled to, means for treating the inlet air prior to delivery thereof to the centrifugal blower assembly.

6 Claims, 13 Drawing Figures

AIR DELIVERY AND TREATMENT APPARATUS

BACKGROUND OF THE INVENTION

1. Field of the Invention

This invention relates to air handling mechanisms and more particularly to an apparatus for optionally delivering inlet air to a centrifugal blower assembly from a plurality of air sources and which may be adapted to treat the inlet air.

2. Description of the Prior Art

In the field of air handling equipment, centrifugal blower assemblies have long been employed for air movement purposes such as ventilation, fume exhaust, and air movement through air conditioning devices such as evaporative coolers, refrigeration units, and the like. Centrifugal blower assemblies have been designed in almost every conceivable size, volumetric output capacity, and pressure range. Also, these blowers have been constructed in down-draft, up-draft, and side draft configurations with many angular variations thereof.

Such centrifugal blower assemblies, regardless of application and the above described variables, are all provided with the same basic components and operate in the same basic manner. In general, centrifugal blower assemblies include a spiral shaped housing having an opposed pair of axial air inlet openings and a centrifugal air outlet opening. Air is drawn into the axial inlets of the blower housing and expelled from the centrifugal outlet thereof by a motor driven impeller mounted axially between the axial air inlet openings.

In air conditioning applications, for which the apparatus of the present invention is ideally suited, such centrifugal blower assemblies are mounted within an enclosing housing so that inlet air to the blower assembly can only be obtained from the ambient air within that housing and delivered externally from that enclosed housing through the centrifugal outlet opening of the blower assembly. The ambient air within the enclosed housing is normally supplied thereto from a single source such as a heating unit, refrigeration unit, or other air treating apparatus as determined by the particular type of air conditioning apparatus. Such air conditioning units may be described as single purpose devices since the air delivered thereby is derived from a single source.

Several multi-purpose air conditioning units have been devised wherein the ambient air within the enclosed housing surrounding the centrifugal blower assembly may be optionally supplied thereto from more than a single source. However, such combination units have heretofore employed one or more centrifugal blower assemblies, complex ducting and air flow control devices, special adapter housings, and the like. Accordingly, such prior art combination devices have been relatively complicated, expensive, and unattractive units. For example, such a prior art multi-purpose air conditioning mechanism may include a central air mixing housing having the centrifugal blower assembly mounted therein and in which damper devices are provided for admitting inlet air to the mixer housing from air treating mechanisms affixed to the mixer housing. Such an air conditioning mechanism may have a conventional existing type of heating device affixed to one side of the mixer housing and a conventional existing type of refrigeration device affixed to the opposite side thereof. Thus, by selective positioning of the damper's devices, inlet air to the mixer housing may be provided through either the heating unit or the refrigeration unit. It may now be seen that by affixing conventional existing air conditioning mechanisms to a special mixer housing a relatively large, complex, and unsightly device results.

It should be noted that such prior art multi-purpose air conditioning units make no provisions for the recirculation of previously treated air and further enclosing structures, ducting, and damper devices would be needed to provide means for accomplishing that function.

One particular prior art multi-purpose air conditioning apparatus is disclosed in U.S. Pat. No. 3,802,493, entitled, "Air Conditioning Apparatus", issued Apr. 9, 1974, to the same inventor. Briefly, that apparatus is a down-draft air delivery mechanism which combines the function of evaporative cooling with other types of air treatment functions. Since this apparatus is a down-draft evaporative cooler, the bottom of the enclosing housing must contain the outlet through which air from the centrifugal blower is delivered and must also have a sump for containing water necessary for the evaporative cooling function. The bottom of the enclosing housing is formed with an upstanding barrier which isolates the centrifugal blower outlet from the sump area and also provides space between the sump and the centrifugal blower outlet for auxiliary air inlets. The upstanding barrier is also employed to carry the centrifugal blower assembly and suitable damper assemblies, which, in conjunction with dampers provided in the auxiliary air inlets, provide the apparatus with the capability of supplying inlet air to the centrifugal blower assembly from either the auxiliary air inlets or from the usual evaporative cooler pads provided on the enclosing housing. By locating various types of air treating devices, such as a heating coil, within the auxiliary air inlets, this particular prior art apparatus may function in a multi-purpose capacity of combining evaporative cooling with various other types of air conditioning functions.

The problems of combining an evaporative cooling function with other types of air conditioning functions in a single apparatus are complex in that the water necessary for the evaporative cooling function must be kept isolated from the other air treating devices and from the centrifugal blower assembly. These problems are further compounded when it is necessary that the single apparatus be configured in a down-draft air delivery mechanism. Thus, by necessity, the apparatus disclosed in the above cited U.S. Patent contains features and elements particularly adapted to solve the problems of that particular type of apparatus.

It may now be seen that the hereinbefore described prior art multi-purpose air conditioning mechanisms have either been relatively large, expensive, and unsightly conglomerations of limited capability or have been devised to solve the particular problems of a specific type of mechanism.

Therefore, the need exists for a new and useful multi-purpose air delivery and treatment apparatus.

SUMMARY OF THE INVENTION

In accordance with the invention, a new and useful air conditioning apparatus is provided for optionally supplying inlet air to a centrifugal blower assembly from more than one source and treating that inlet air prior to its being supplied to the centrifugal blower assembly.

A centrifugal blower assembly having the usual opposed pair of axial inlet openings and a centrifugal outlet opening is provided with an inlet air flow control and conditioning apparatus adjacent to each of the axial inlet openings. Each of the inlet air flow control and conditioning devices has at least a pair of air source openings formed therein through which inlet air may be optionally supplied to the centrifugal blower assembly. Suitable damper assemblies are provided to selectively open and close the air source openings thus providing the air inlet flow control function of the control and conditioning apparatus. Each of the inlet air flow control and conditioning devices are provided with air treatment apparatus mounted therein for conditioning the inlet air prior to its being drawn into the axial inlet openings of the centrifugal blower aseembly. The air treatment devices provided within the air inlet flow control and conditioning apparatus may include heat exchanger elements to which a heating or cooling medium is supplied from such devices as a conventional heater, conventional refrigeration, heat pump, water heating and cooling appliances, and the like.

Additional embodiments of the apparatus of the present invention are also disclosed with the first of those additional embodiments being a simplified compact structure solely for the purpose of optionally delivering air from a plurality of sources without treating that air within the apparatus itself. A second additional embodiment is configured especially for air recirculation purposes and which may be provided with the capability of treating the recirculated air if desired.

Accordingly, it is an object of the present invention to provide a new and useful air handling mechanism.

Another object of the present invention is to provide a new and useful mechanism for delivering air with that air being optionally obtained from a plurality of inlet air supply sources.

Another object of the present invention is to provide a new and useful mechanism for deliverying air with that air being optionally obtained from a plurality of inlet air supply sources and for treating that air prior to delivery thereof.

Another object of the present invention is to provide a new and useful mechanism for recirculating air.

Another object of the present invention is to provide a new and useful mechanism for recirculating air and for treating that recirculated air.

Another object of the present invention is to provide a new and useful air delivery and treatment apparatus.

Another object of the present invention is to provide a new and useful air delivery and treatment apparatus for selectively delivering inlet air from a plurality of air supply sources to the axial inlet openings of a centrifugal blower assembly.

Still another object of the present invention is to provide a new and useful air delivery and treatment apparatus which optionally delivery inlet air to the axial inlet openings of a centrifugal blower assembly from a plurality of air supply sources and which may treat that inlet air prior to its being drawn into the blower assembly.

Yet another object of the present invention is to provide a new and useful air delivery and treatment apparatus in which a centrifugal blower assembly is provided with an air inlet flow control and conditioning apparatus adjacent to each of the axial inlet openings for selectively directing air from a plurality of sources to the axial inlet openings and treating that air with treatment means provided within the air inlet flow control and conditioning apparatus.

The foregoing and other objects of the present invention, the various features thereof, as well as the invention itself, may be more fully understood from the following description when read in conjunction with the accompanying drawings.

DESCRIPTION OF THE PREFERRED EMBODIMENTS

Figure 1:
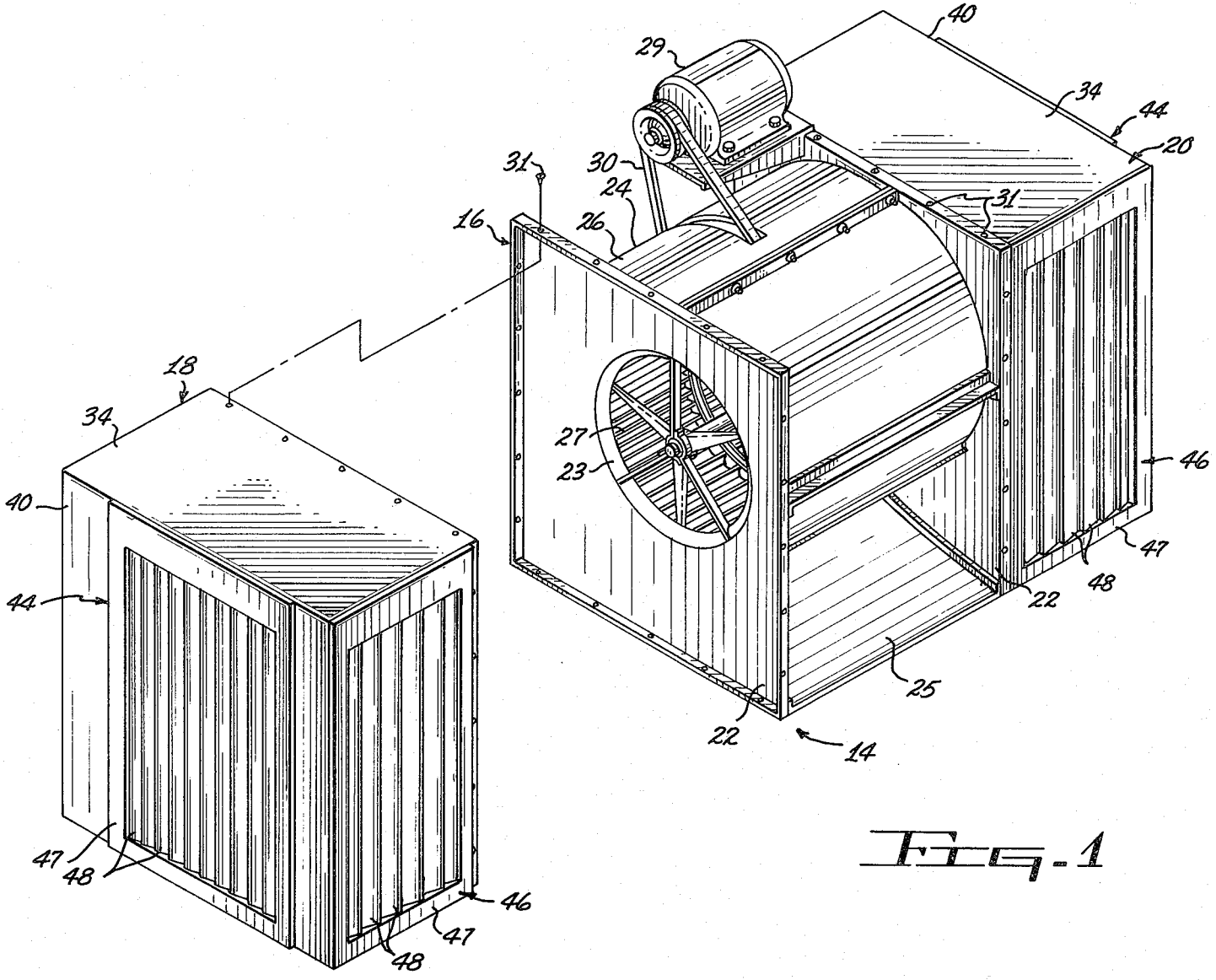
FIG. 1 is a partially exploded isometric view of the apparatus of the present invention.

Referring more particularly to the drawings, FIG. 1 illustrates the air delivery and treatment apparatus of the present invention which is indicated generally by the reference numeral 14. The apparatus 14, as will hereinafter be described in detail, is fabricated from three major subassemblies, a centrifugal blower assembly 16, and a pair of inlet air flow control and conditioning devices 18 and 20. The devices 18 and 20 are suitably affixed to opposite sides of the blower 16 for reasons which will become apparent as this description progresses.

It should be understood that the above described three major subassembly type of construction is the preferred fabrication technique, as a single housing (not shown) could be devised for containing all the necessary components to accomplish the objectives of the present invention, and such an alternate form of construction would merely be a design expedient.

Since the inlet air flow control and conditioning devices 18 and 20 are affixed to the opposite sides of the centrifugal blower assembly, it is preferred that a specific type of centrifugal blower assembly be employed. As is well known in the art, a large part of the normal servicing and maintenance of a conventional centrifugal blower assembly must be accomplished from the sides of that assembly. Thus, this type of servicing and maintenance would be extremely difficult, due to the location of the devices 18 and 20, if a conventional centrifugal blower assembly were employed. Therefore, the centrifugal blower assembly 16 is preferred for use in the apparatus of the instant invention, and that specific type of centrifugal blower assembly is fully disclosed in U.S. Pat. No. 3,746,464 issued July 17, 1973, to the same inventor.

Briefly, the centrifugal blower assembly 16 includes a pair of vertically disposed spaced apart side walls 22 each having an opening formed therein which serve as the axial air inlets 23 of the blower assembly. A spiral shaped surface 24 extends between the side walls 22 and is configured to form the plenum chamber and centrifugal outlet 25 of the blower. The surface 24 is provided with a removable segment 26 which provides access to all the necessary service and maintenance points of the blower 16. An impeller or rotor 27 is rotatably axially mounted between the axial air inlets 23 formed in the side walls 22, and the rotor 27 is formed with a centrally disposed pulley 28 so that the rotor 27 may be center driven by a suitably mounted motor 29 and belt 30.

Figure 2:
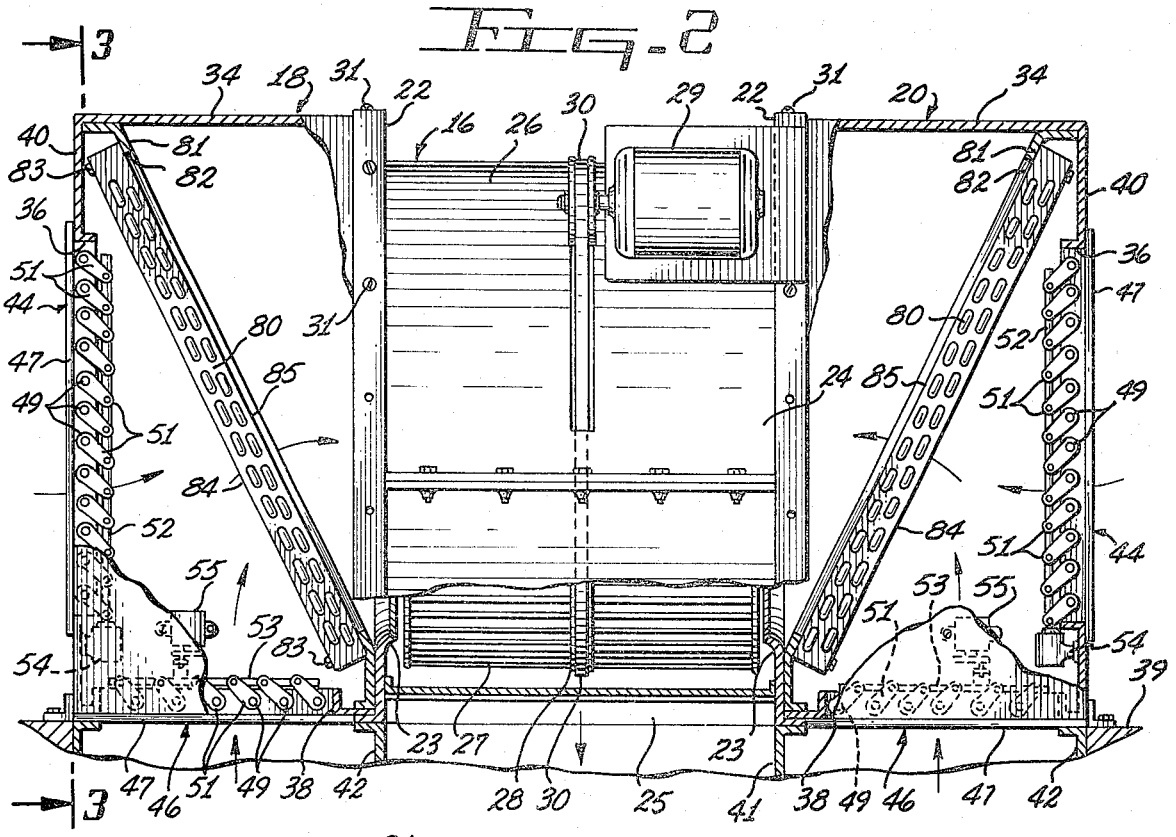
FIG. 2 is a plan view partially broken away to illustrate the various features of the apparatus of the present invention.
Figure 4:
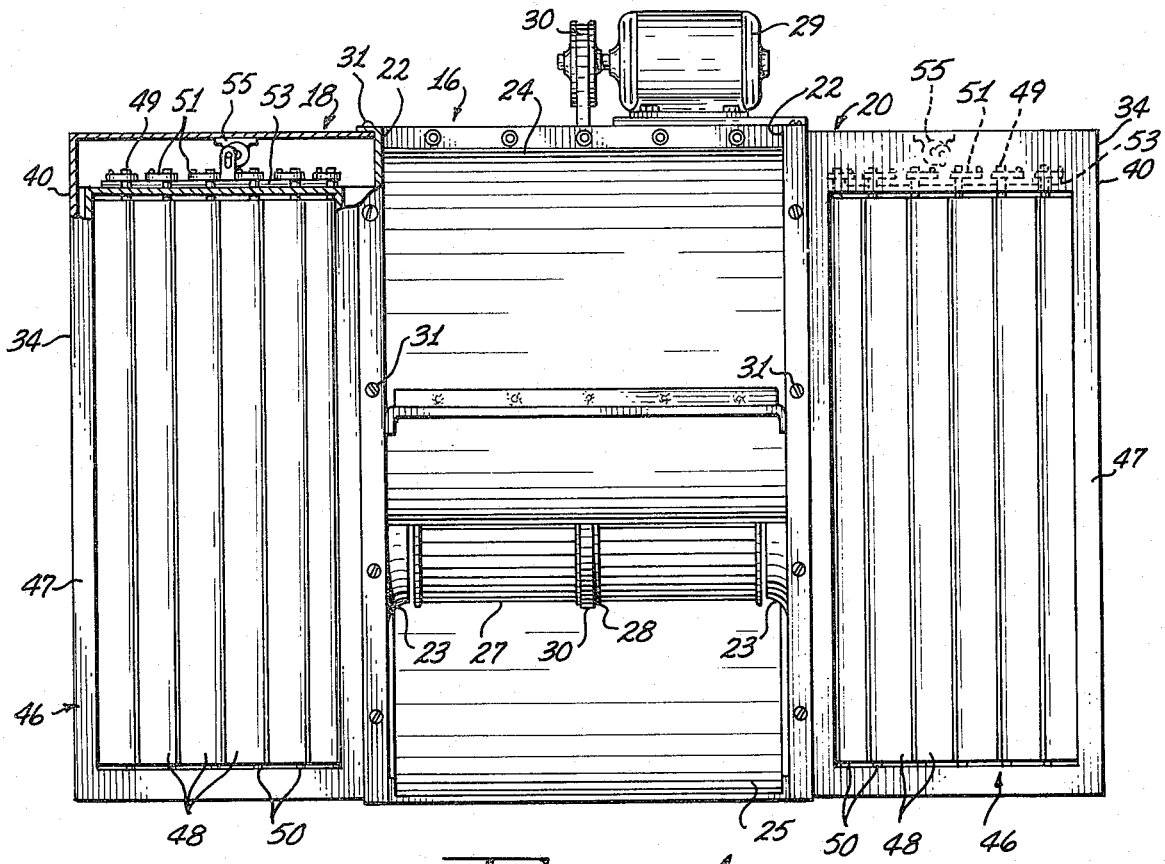
FIG. 4 is an elevational view of the apparatus of the present invention and which is partially broken away to show the various features thereof.

As seen best in FIGS. 1, 2, and 4, the inlet air flow control and conditioning devices 18 and 20 are affixed to the side walls 22 of the centrifugal blower assembly 16, such as with sheet metal screws 31, which locates these devices 18 and 20 adjacent to opposite ones of the axial air inlets 23 of the blower assembly. As is well known, inlet air is drawn into a centrifugal blower assembly through the axial inlets thereof by action of the rotor and that inlet air is obtained from the ambient air adjacent the axial inlets. Thus, in the apparatus 14, inlet air to the blower assembly 16 must pass through the inlet air flow control and conditioning devices 18 and 20.

Each of the inlet air flow control and conditioning devices 18 and 20 are identical; therefore, the following detailed description of the device 18 should be understood to also apply to the device 20.

The inlet air flow control and conditioning device 18 includes a cabinet shaped structure 34 which is open on the side thereof which is adjacent the axial inlet 23 of the blower assembly 16 so that the interior compartment of the cabinet 34 is in direct communication with the axial inlet. The cabinet 34 is provided with a first air supply opening 36 and a second air supply opening 38 so that air may be supplied optionally through either of these openings into the interior of the cabinet. It should be understood that the number and location of these air supply openings can be varied to suit particular installation and application requirements. For illustrative and descriptive purposes, the first air supply opening 36 is provided in the side wall 40 of the cabinet 34 and the second air supply opening 38 is formed in the end wall of the cabinet so as to place that opening 38 laterally adjacent the centrifugal outlet 25 of the blower 16.

FIG. 2 illustrates the apparatus 14 as being suitably mounted on a structure 39, such as the wall of a building, so that the centrifugal outlet 25 of the blower assembly 16 is in aligned communication with an air delivery duct 41. As is customary, the air delivery duct 41 is employed to convey air from the centrifugal outlet 25 to a specific area or areas (not shown). A pair of return air ducts 42 may be provided in the structure 39 on opposite sides of the air delivery duct 41 so as to be in aligned communication with the second air supply openings 38 of the inlet air flow control and conditioning devices 18 and 20. Thus, location of the second air supply openings 38 laterally adjacent to the centrifugal outlet 25 of the lower assembly 16 provides the apparatus 14 with the capability of recirculating air in a simplified manner with a minimum amount of mechanisms.

Locating the first air supply openings 36 in the side walls of their respective devices 18 and 20, provides the apparatus 14 with the capability of utilizing ambient air adjacent to the apparatus 14 for delivery and conditioning purposes. It should be noted that inlet air drawn into the devices 18 and 20 through the first air supply openings 36 thereof may, if desired, be obtained from a remote source by simply coupling suitable ducting (not shown) to those openings 36.

It should now be apparant that inlet air supplied to the apparatus 14 may be obtained from various sources, and, as will now be explained in detail, means for optionally selecting between these sources is provided within the air flow control and conditioning devices 18 and 20.

The means for optionally selecting between inlet air sources may take the form of a damper mechanism 44 adjacent the first air supply inlet opening 36 of the device 18 and a similar damper mechanism 46 adjacent the second air supply inlet opening 38 of that device. In the preferred embodiment, each of the damper mechanisms 44 and 46 include a frame 47 suitably affixed within their respective openings 36 and 38 such as by welding. Each of the frames 47 is provided with a plurality of vertically disposed louvers 48 mounted therein in a manner so as to be rotatable about their respective longitudinal axes through approximately 90° of rotation between a closed and an open position. Each of the louvers 48 have an upper pivot pin 49 and a lower pivot pin 50 extending from opposite ends thereof for pivotably affixing the louvers within the frames. The upper pivot pin 49 of each of the louvers 48 extends upwardly through the frame 47, and a lever 51 is affixed to the upper end thereof. A tie rod 52 interconnects each of the levers 51 of the damper mechanism 44 for ganged movement of the louvers of that mechanism and a tie rod 53 is connected to each of the levers 51 for ganged operation of the louvers 48 of the damper mechanism 46. Suitable servo motors 54 and 55 are connected to the tie rods 52 and 53, respectively, for reciprocally moving the tie rods to cause the louvers 48 to move within their respective damper mechanisms 44 and 46.

The servo motors 54 and 55 may be of any well known type such as electric, hydraulic, pneumatic, and the like, and also may be actuated in any convenient manner such as manually or automatically controlled by a timing mechanism (not shown), or under the control of a thermostat device (not shown).

Figure 5:
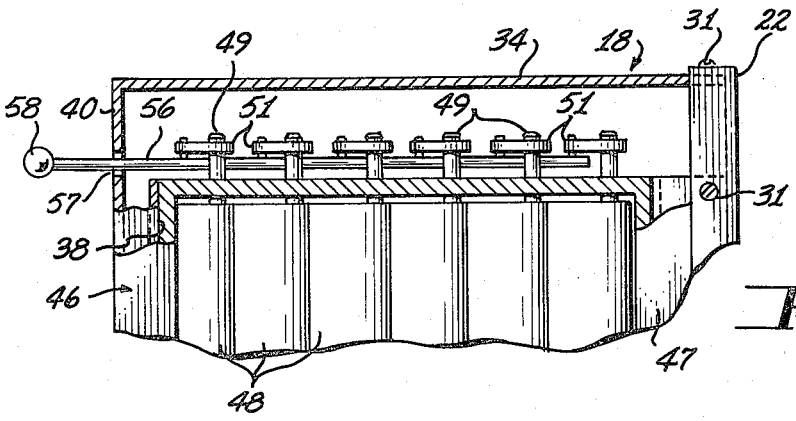
FIG. 5 is an enlarged fragmentary elevational view of a portion of the apparatus of the present invention with the drawing partially broken away to illustrate a modification of the apparatus.

FIG. 5 illustrates a modification of the damper mechanism 46 which includes the same previously described basic elements of the frame 47, louvers 48, and levers 51. However, in this embodiment, a modified tie rod 56 is employed for interconnecting the levers 51. The tie rod 56 extends through an opening 57 formed in the side wall 40 of the cabinet 34 and is provided with a suitable handle 58 thereon by which the louvers may be manually positioned.

Figure 7:
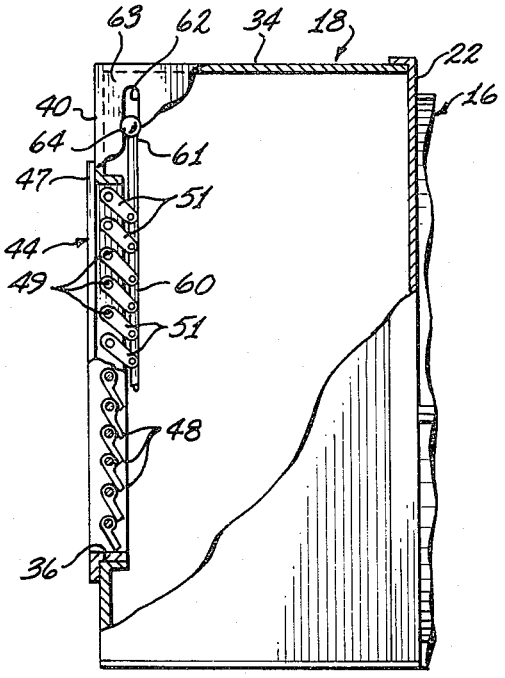
FIG. 7 is a fragmentary plan view partially broken away to illustrate another modification of the apparatus of the present invention.

FIG. 7 shows the above described modification as being adapted for use on the damper mechanism 44. A tie rod 60, which interconnects the levers 51 is bent at 61 into a substantially 90° configuration so that a portion of the tie rod 60 extends upwardly through an opening 62 provided in the top 63 of the cabinet 34. A suitable handle 64 is provided on the uppermost end of the tie rod 60 by which the damper mechanism 44 may be manually operated.

Figure 6:
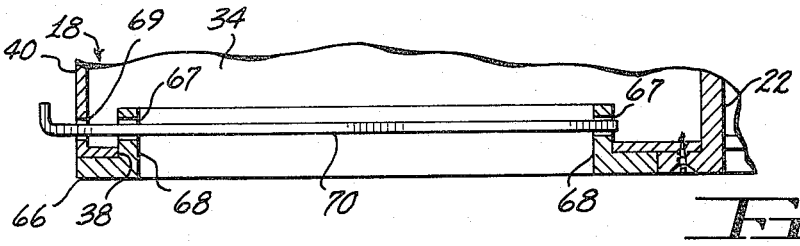
FIG. 6 is a fragmentary sectional view of a portion of the apparatus of the present invention which illustrates another modification thereof.
Figure 8:
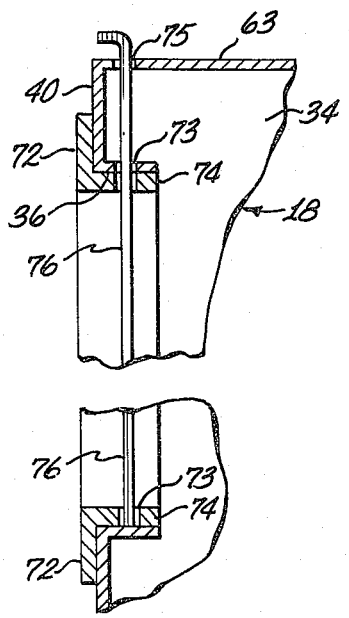
FIG. 8 is a fragmentary sectional view illustrating another modification of the apparatus of the present invention.

FIGS. 6 and 8 illustrate another type of mechanism which may be employed in lieu of the above described mechanisms 44 and 46 to accomplish the function of optionally opening and closing the first and second air supply openings 36 and 38. FIG. 6 shows the second air supply opening 38 as having a frame 66 suitably affixed therein with that frame having a vertically extending elongated slot 67 formed in each of the vertical members 68 of the frame. The slots 67 are in alignment with each other and with a similar slot 69 formed in the side wall 40 of the cabinet 34. A flat plate 70 is slidingly movable in the slot 69 of the cabinet 34 and the slots 67 of the frame 66 so as to accomplish the function of opening and closing the second air supply opening 38. FIG. 8 shows the first air supply opening 36 having a frame 72 suitably affixed therein with that frame having a horizontally extending elongated slot 73 formed in each of the horizontal members 74 thereof. A similar horizontally extending elongated slot 75 is formed in the top 63 of the cabinet 34 and is in alignment with the slots 73 of the frame 72. A flat plate 76 is slidingly movable in the slot 75 of the cabinet 34 and in the slots 73 of the frame 72 for opening and closing of the first air supply opening 36.

Figure 3:
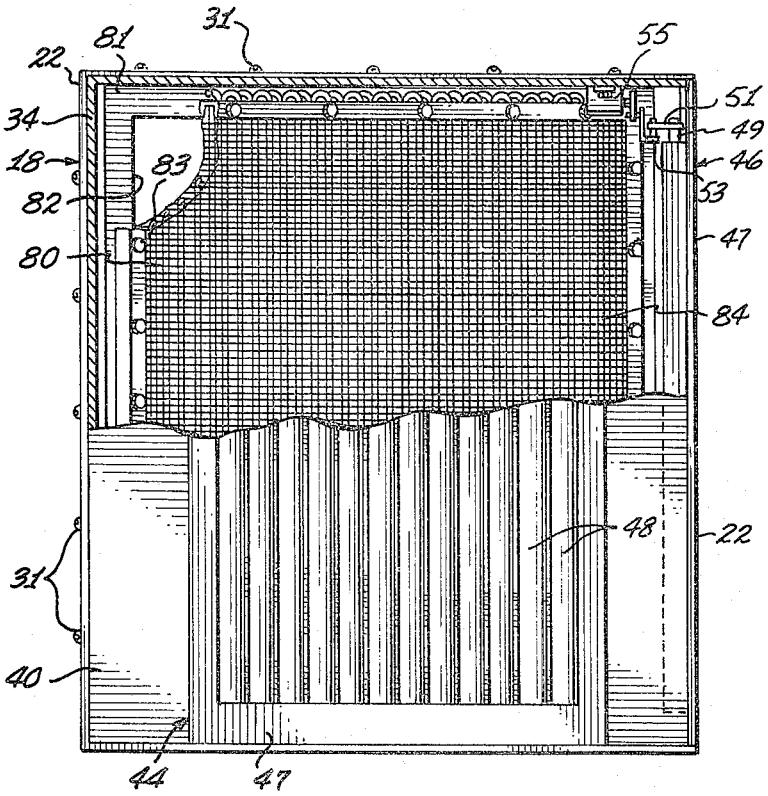
FIG. 3 is a sectional view taken on the line 3—3 of FIG. 2.

As shown best in FIGS. 2 and 3, each of the inlet air flow control and conditioning mechanisms 18 and 20 is provided with an air treatment means 80 therein which is shown in the form of a heat exchanger unit. A frame 81, having a central opening 82 formed therethrough, is suitably mounted in the cabinet 34 such as by welding and is disposed to extend diagonally therein. The air treatment means 80 is mounted on the frame 81, such as with bolts 83, so that air inlet side 84 of the air treatment means 80 faces toward both the first and the second air supply openings 36 and 38 of the cabinet 34 and the air discharge side 85 of air treatment means 80 faces toward the axial inlet 23 of the centrifugal blower assembly 16. Therefore, the supply of inlet air may enter into the interior of the cabinet 34 through either the first or the second air supply openings 36 or 38, as previously described, and will pass through the air treatment means 80 on the way into the centrifugal blower assembly 16.

A suitable heating or cooling medium may be supplied to the air treatment means 80 from remotely located equipment such as a conventional heating device (not shown), conventional refrigeration device (not shown), and the like. An example of one type of system ideally suited for use in conjunction with the apparatus of the present invention is to circulate cold water from a water cooling apparatus (not shown) through the heat exchanger elements to cool the inlet air passing therethrough. With suitable switching valves (not shown) the same system of heat exchanger elements could be employed to circulate hot water from a suitable water heating apparatus (not shown) to heat the inlet air supply.

It should be understood that other types of air treatment means could be mounted within the air inlet flow control and conditioning mechanisms 18 and 20, such as air filtering devices (not shown).

Figure 9:
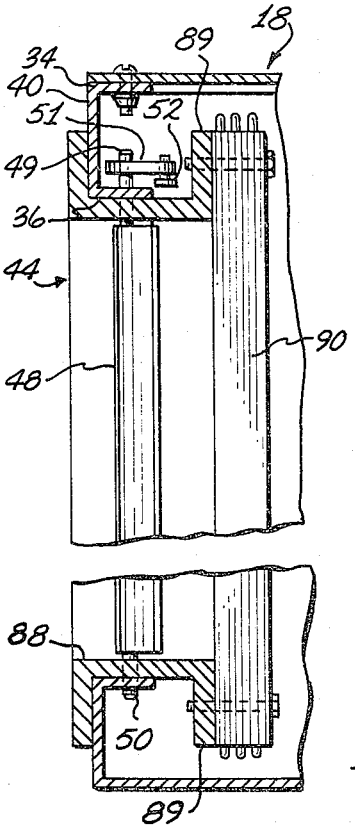
FIG. 9 is a fragmentary sectional view illustrating another modification of the apparatus of the present invention.

FIG. 9 shows the first air supply opening 36 of the air flow control and conditioning device 18 as having a modified form of the damper assembly 44 mounted therein. In this modification, the previously described frame 47 is replaced with a special frame 88 having a mounting flange 89 on the inwardly disposed portion thereof. The mounting flange 89 is employed for mounting an air treatment means 90 in juxtaposed relationship with the damper mechanism 44 directly in the air flow path through the first supply opening 36 of the device 18.

Figure 10:
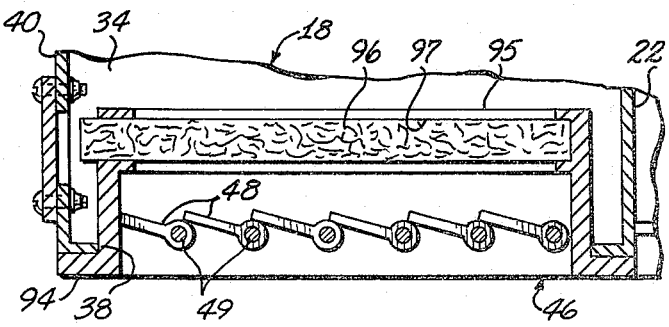
FIG. 10 is a fragmentary sectional view which illustrates another modification of the apparatus of the present invention.

FIG. 10 shows the second air supply opening 38 of the air flow control and conditioning device 18 as having a modified form of the damper assembly 46 mounted therein. A special frame 94 replaces the previously described frame 47 and this special frame 94 is provided with a mounting flange 95 on the inwardly disposed portion thereof. The mounting flange 95 is employed for mounting an air treatment means 96 in juxtaposed relationship with the damper mechanism 46 directly in the air flow path through the second air supply opening 38 of the device 18. The mounting flange 95 is shown as having a U-shaped channel 97 formed therein for slidingly receiving the air treatment means 96 therein which is shown as an air filter.

It should now be apparent that by employing the modifications of the damper mechanisms 44 and 46 as shown in FIGS. 9 and 10, various combinations of air treatment functions may be accomplished. This may be easily seen upon consideration of the particular combination shown wherein the air treatment means 90 will only treat the inlet air passing through the opening 36, and the air treatment means 96 will only treat the inlet air passing through the opening 38. Thus, in this particular arrangement, fresh air will be heated and/or cooled by the air treatment means 96.

It should be understood that the air delivery and treatment apparatus 14 described above may be further modified to suit particular installation and application requirements.

A first of such modifications would be employed to solely deliver air from a plurality of optionally selectable sources. That is, the apparatus 14 may be utilized without any air treatment devices therein, and will therefore deliver air to a given area in substantially the same condition as that air is received by the blower assembly. Further, the air received by the blower assembly 16 may be treated externally of the apparatus 14 with suitable devices (not shown) and coupled to one or more of the air supply openings of the apparatus.

Figure 11:
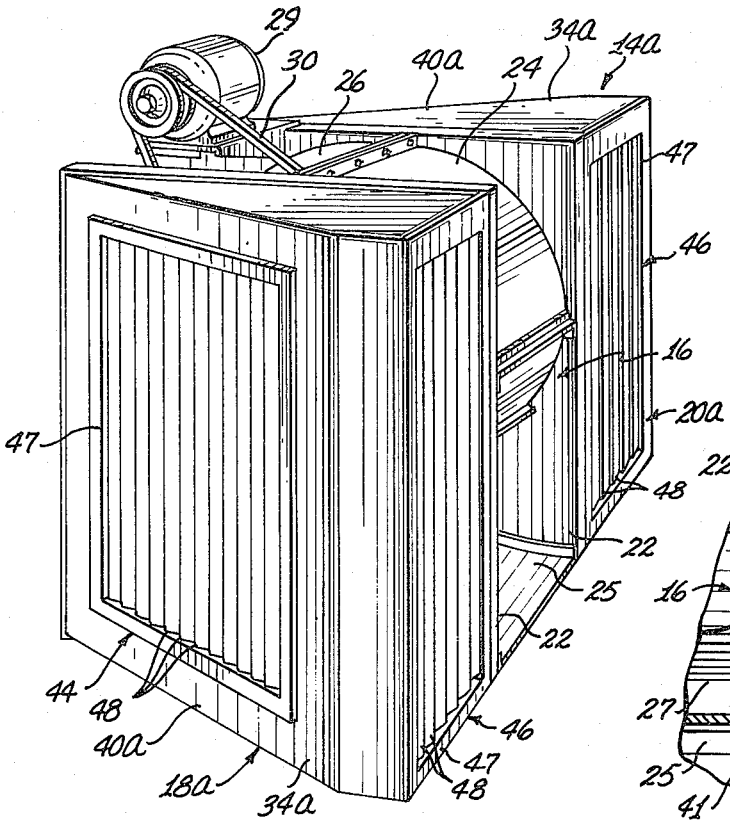
FIG. 11 is a perspective view of another embodiment of the apparatus of the present invention.
Figure 12:
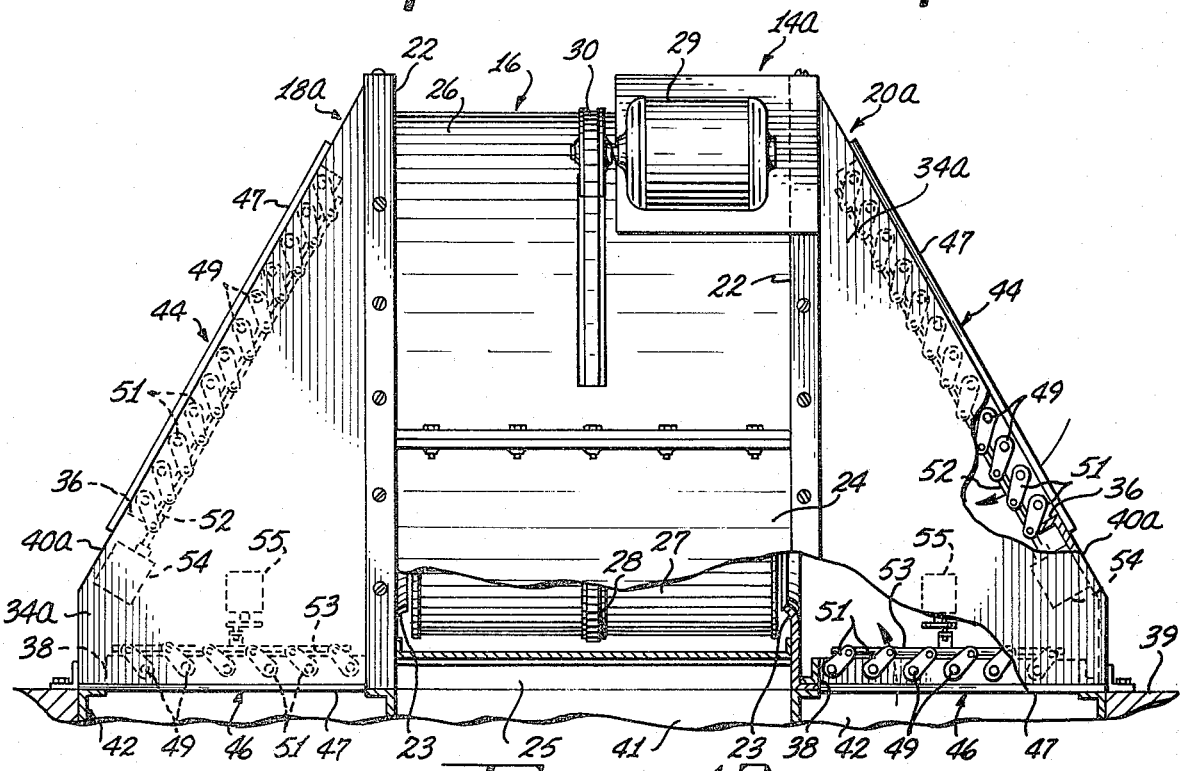
FIG. 12 is a plan view of the apparatus shown in FIG. 11 which is partially broken away to show the various features thereof.

Therefore, a simplified embodiment of the air delivery and treatment apparatus 14 is shown in FIGS. 11 and 12 as an air delivery apparatus 14*a*. In this embodiment, the air flow control devices 18*a* and 20*a* employ a simplified cabinet structure 34*a* having an angularly disposed side wall 40*a* which substantially reduces the size of the cabinet and thus requires less materials to fabricate and will occupy less space. The apparatus 14*a* is provided with the same previously described centrifugal blower assembly 16, and each of the devices 18*a* and 20*a* have the same type of previously described damper mechanisms 44 and 46 within the first and second air supply openings 36 and 38.

Figure 13:
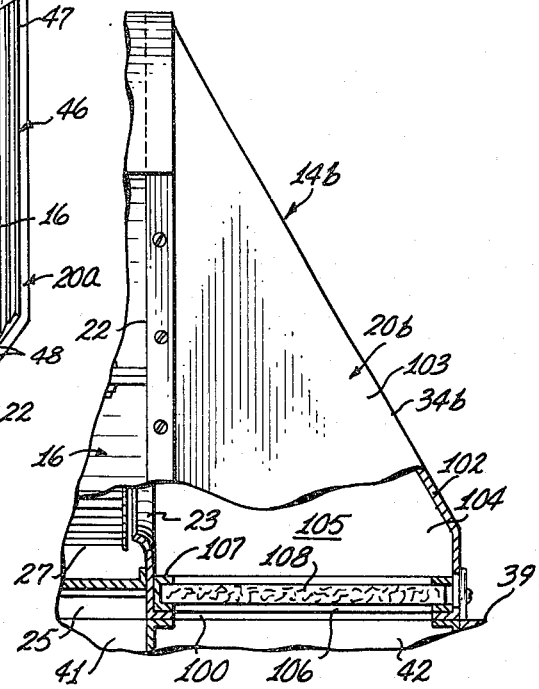
FIG. 13 is a fragmentary plan view of a modification of the apparatus of the present invention which is partially broken away to show the various features thereof.

A seocnd of such modifications is shown in FIG. 13 as a recirculating air apparatus 14*b* through which air is recirculated and that air may be treated or merely recirculated as desired. Such recirculating functions are economically accomplished within the compact apparatus 14*b* which is shown to include the same previously described centrifugal blower assembly 16. As before, the apparatus 14*b* is provided with an identical pair of air control devices with only the device 20*b* being shown. Thus, it should be understood that the following description of the air control device 20*b* also applies to the oppositely mounted identical device which is not shown. In this embodiment, the cabinet structure 34*b* of the air flow control device 20b is configured with a single air supply inlet opening 100 which, in conjunction with the air return duct 42, returns air from an area (not shown) which is receiving air from the centrifugal blower assembly 16 as previously described. The cabinet structure 34*b* is provided with an angularly disposed side wall 102 and opposite end walls 103 and 104 which sealingly enclose the interior compartment 105 of the cabinet so that only the air passing through the inlet opening 100 will enter into the axial air inlet 23 of the centrifugal blower assembly 16. It may now be seen that with the air supply opening 100 disposed in the same plane and laterally adjacent the centrifugal outlet 25, and the cabinet 34*b* otherwise sealed, a very compact apparatus results which accomplishes the air recirculating function with a minimum amount of mechanisms.

If desired, an air treatment function can be provided within the apparatus 14*b* by providing a frame 106 having a mounting flange 107, within the air supply opening 100. Any desired form of air treatment means 108, such as the air filter mechanism shown, can be mounted on the frame mounting flange 107 in the manner previously described.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An air handling mechanism comprising:

a. a centrifugal blower assembly having an air moving blower wheel impeller rotatably mounted between a pair of spaced substantially parallel side walls at least one of which has an axial air inlet opening formed therein, the side walls interconnected with a spiral shaped member to provide a chamber around the impeller and to form a centrifugal air outlet from the chamber; and b. an air flow control mechanism affixed to said centrifugal blower assembly adjacent the one side wall of said centrifugal blower assembly in which the axial air inlet opening is formed, said air flow control mechanism having an interior compartment which is in communication with the axial air inlet opening formed in the one side wall of said centrifugal blower assembly, said air flow control mechanism having an air supply inlet opening formed therein which is disposed laterally adjacent and substantially planar with the centrifugal air outlet of said centrifugal blower assembly.

2. An air handling mechanism as claimed in claim 1 wherein said air flow control mechanism is configured to sealingly enclose the interior compartment thereof so that air may enter into that interior compartment only through the air supply inlet opening thereof.

3. An air handling mechanism as claimed in claim 1 wherein said air flow control mechanism includes a sealed cabinet structure having the air supply inlet opening formed in one wall thereof with that wall being in substantially the same plane as the centrifugal air outlet of said centrifugal blower assembly and disposed laterally adjacent thereto.

4. An air handling mechanism as claimed in claim 1 wherein said air control mechanism further includes an air treatment means mounted therein for treating the air entering thereinto through the air supply inlet opening thereof.

5. An air handling apparatus comprising:

a. a centrifugal blower assembly having a motor driven air moving blower wheel impeller rotatably mounted between a pair of spaced substantially parallel side walls at least one of which has an axial air inlet opening formed therein, the side walls interconnected with a spiral shaped member to provide a chamber around the impeller and to form a centrifugal air outlet from the chamber; and b. an enclosed cabinet affixed to the one side wall of said centrifugal blower assembly which has the axial air inlet opening formed therein, said cabinet having an interior compartment which is in communication with the axial air inlet formed in the one side wall of said centrifugal blower assembly, said cabinet having an air supply opening formed therein through which air is supplied to the interior compartment of said cabinet, the air supply opening of said cabinet being disposed in a wall thereof which is substantially in the same plane as the centrifugal air outlet of said centrifugal blower assembly and is disposed laterally adjacent thereto.

6. An air handling apparatus as claimed in claim 5 further comprising:

a. a frame mounted within the air supply opening formed in said cabinet; and b. air treatment means mounted on said frame so as to be disposed in the air path through the air supply opening of said cabinet, said air treatment means for conditioning the air entering into the interior compartment of said cabinet.

* * * * *